US005975966A

United States Patent [19]

Lin

[11] Patent Number: 5,975,966

[45] Date of Patent: Nov. 2, 1999

[54] PROPELLING SYSTEM OF SMALL BOAT

[76] Inventor: Yeun-Junn Lin, 5F, No. 23, Lane 10, Tian Bao St., Taichung, Taiwan

[21] Appl. No.: 09/192,573

[22] Filed: Nov. 17, 1998

[51] Int. Cl.[6] ..... B63H 11/103

[52] U.S. Cl. ..... 440/47; 440/38

[58] Field of Search ..... 440/38, 39, 46, 440/47; 60/221, 222

[56] References Cited

U.S. PATENT DOCUMENTS 5,683,276 11/1997 Jordan ..... 440/47

*Primary Examiner*—Jesus D. Sotelo

*Attorney, Agent, or Firm*—Browdy and Neimark

[57] ABSTRACT

A boat propelling system is mounted in a water channel of the boat hull and composed of an engine, a transmission shaft driven by the engine, an impeller driven by the transmission shaft and provided with blades, a stator mounted behind the impeller and provided with stator vanes, and a nozzle located behind the stator. The impeller blades and the stator vanes are separated by a gap adjustable by the magnitude of jet flow of water.

4 Claims, 3 Drawing Sheets

PROPELLING SYSTEM OF SMALL BOAT

FIELD OF THE INVENTION

The present invention relates generally to a small boat, and more particularly to a propelling system of the small boat.

BACKGROUND OF THE INVENTION

The conventional water scooter is provided with an impeller for drawing and compressing water flow, which is then forced through a nozzle to form jet flow to propel the boat. As shown in FIG. 1, the propelling system of the prior art consists of an engine 12 mounted in the hull 10, a transmission shaft 13 driven by the engine 12 and fastened at the rear end thereof with an impeller 14. The rear end of the transmission shaft 13 is located in a channel 11 of the hull 10. A stator 15 is located in the channel 11 and behind the impeller 14. The stator 15 has an axial portion of a straight cylindrical construction. The axial portion is provided in the periphery thereof with a plurality of stator vanes 151.

In operation, the transmission shaft 13 is driven by the engine 12 to actuate the impeller 14 to rotate rapidly to draw the water into the channel 11 in which the water is compressed. The compressed water is guided into the stator 15. The water flow in the state of vortex is guided by the stator vanes 151 to move forward in a linear direction parallel to the channel 11. The backward thrust of water is generated by the water flow passing the nozzle 16, so as to propel the hull 10.

The size of the gap between the blades 141 of the impeller 14 and the stator vanes 151 of the stator 15 plays an important role in determining the efficiency of the propelling system. The gap of the conventional propelling system described above is so fixed that it can not be adjusted. If the gap is relatively small, the composite flow speed of water flow increases relatively at the time when the power boat is cruising at a high speed. As a result, the entry angle of the water flow becomes greater such that the water flow can not be guided into the stator vanes precisely and efficiently, and that the efficiency of the propelling system is thus seriously undermined. If the gap is relatively large, the composite flow speed of water flow decreases relatively at such time when the power boat is started to cruise or is cruising slowly. As a result, the erosion phenomenon of the power boat is easily brought about.

SUMMARY OF THE INVENTION

The primary objective of the present invention is to provide a power boat with a propelling system having an adjustable gap between the stator vanes and the impeller blades for optimizing the operation of the propelling system.

It is another objective of the present invention to provide a power boat with a propelling system capable of minimizing the erosion phenomenon of the power boat at the time when the power boat is started to cruise or cruising slowly.

The propelling system of the present invention consists of an engine, an impeller driven by the engine, a stator mounted behind the impeller, and a nozzle located behind the stator. The gap between the impeller blades and the stator vanes is automatically adjusted in its size in accordance with the magnitude of the jet flow of water.

The objective, features, functions and advantages of the present invention will be more readily understood upon a thoughtful deliberation of the following detailed description of the present invention with reference to the accompanying drawings.

DETAILED DESCRIPTION OF THE INVENTION

Figure 1:
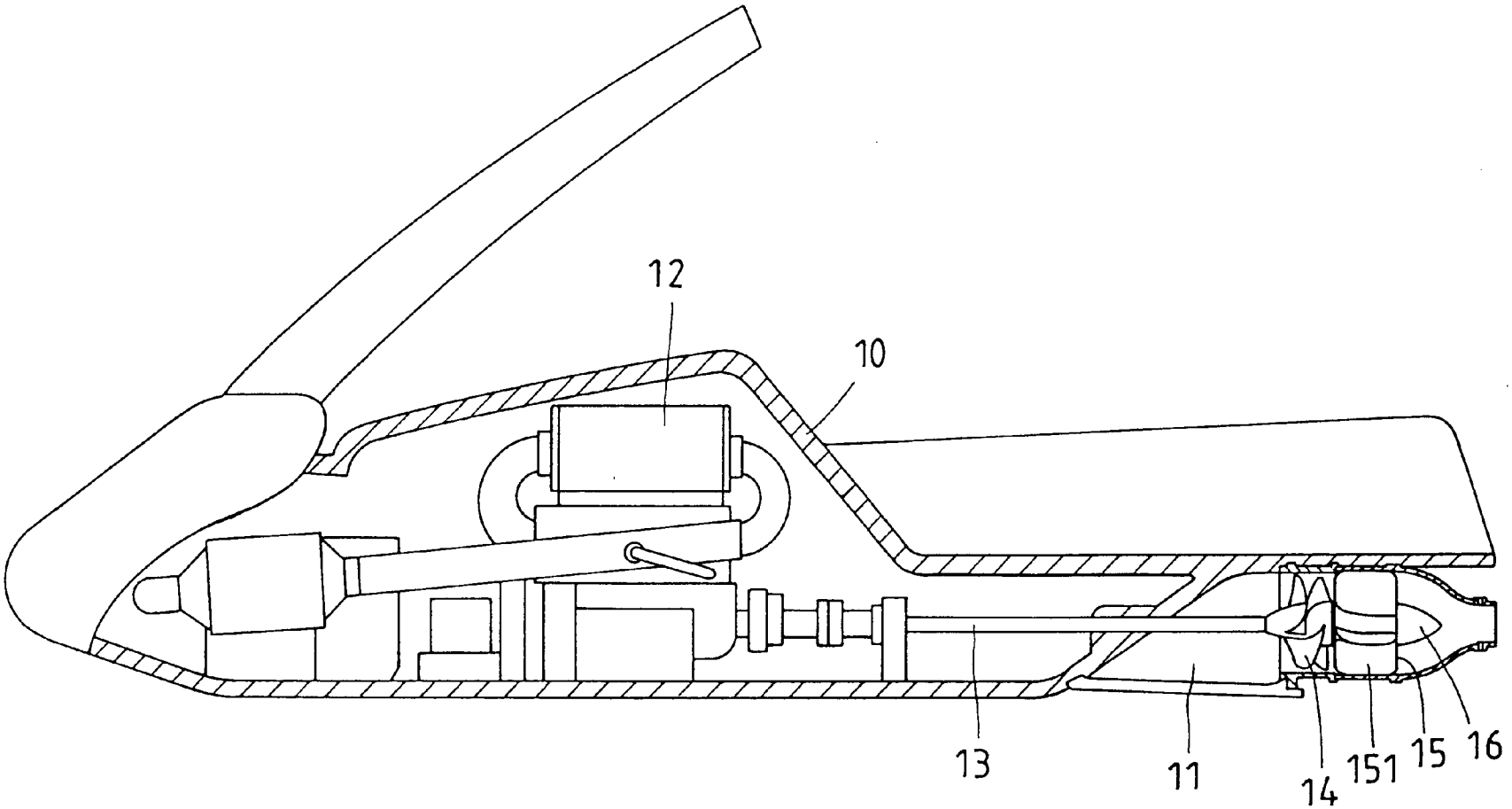
FIG. 1 shows a schematic view of a propelling system of the conventional water scooter.
Figure 2:
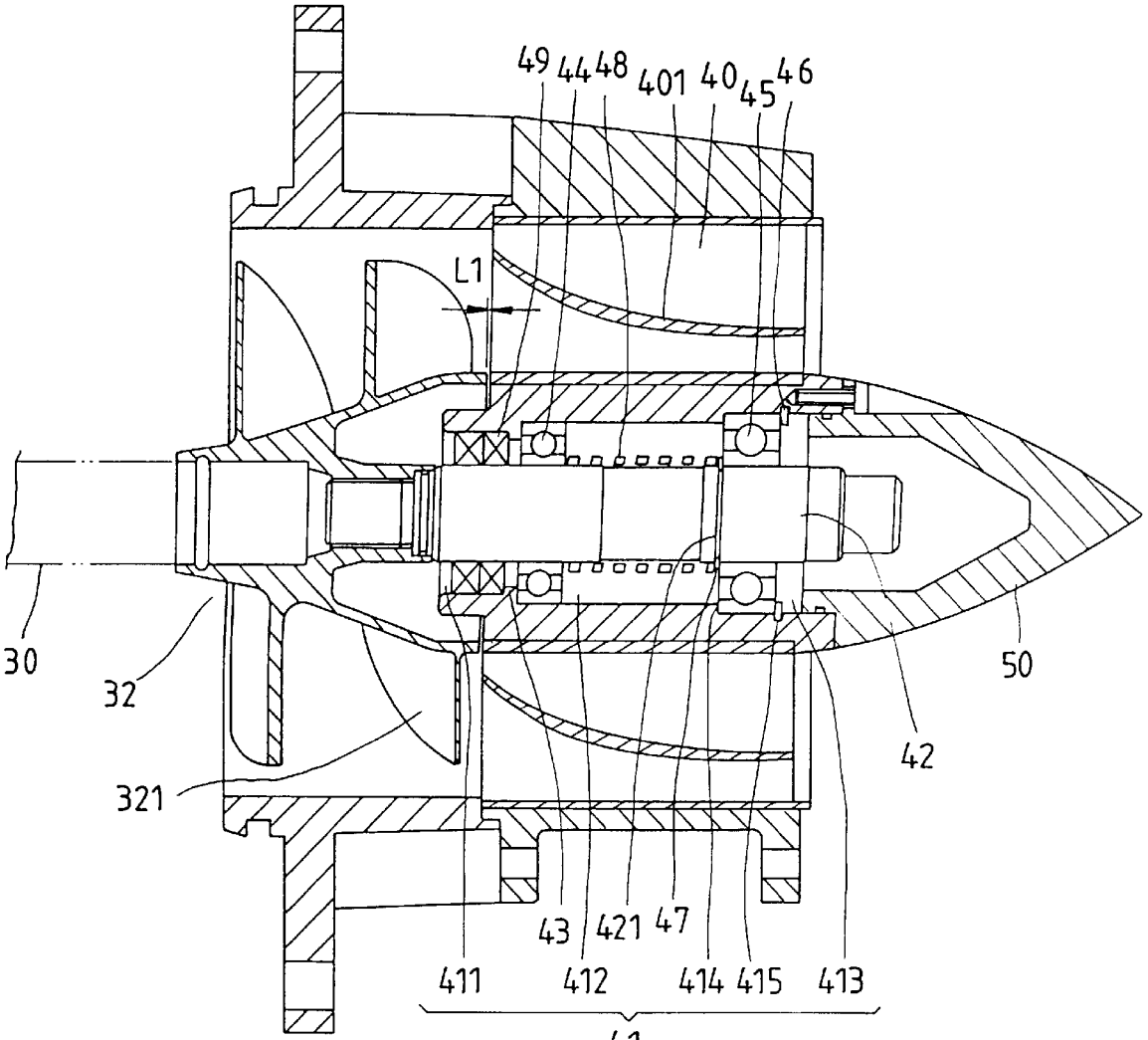
FIG. 2 shows a longitudinal sectional view of a propelling system of the present invention, with the spring remaining in the normal state.

As shown in FIG. 2, the propelling system of the present invention is mounted in the water channel of the hull, as is the case with the conventional propelling system.

The propelling system of the present invention consists of an engine (not shown in the drawing), a transmission shaft 30 driven by the engine, an impeller 32 fastened with the rear section of the transmission shaft 30, a stator 40 mounted on the rear end of the impeller 32, and a nozzle 50 for discharging the water compressed by blades 321 of the impeller 32. The stator 40 has an inner axial hole 41, which is engaged with the impeller 32 by a shaft rod 42. The axial hole 41 is provided in the inner edge of the front section thereof with an arresting protrusion 43 which causes the axial hole of both sides to form a first round hole section 411 and a second round hole section 412 different in hole diameter from the first round hole section 411. The second round hole section 412 is provided in the rear end thereof with a third round hole section 413 having a greater hole diameter. Located between the third round hole section 413 and the second round hole section 412 is a stepped portion 414. The third round hole section 413 is provided in the middle thereof with a retaining slot 415. Two bearings 44 and 45 are respectively contiguous to the arresting protrusion 43 and the stepped portion 414 for keeping the shaft rod 42 straight when in operation. The bearing 45 has an outer end which is pressed against by a retaining ring 46 located in the retaining slot 415 such that the bearing 45 is secured in the third round hole section 413. The shaft rod 42 is provided with a circular slot 42 for retaining a retaining ring 47. The shaft rod 42 is fitted into a spring 48 urging the first bearing 44 and the retaining ring 47 and providing the shaft rod 42 with force enabling the shaft rod 42 to slide axially. Two oil seals 49 are engaged with the first round hole section 411 for preventing the water from flowing into the axial hole 41 of the stator 40.

The front end of the impeller 32 is fastened pivotally with the transmission shaft 30 by means of rack such that the rear end of the impeller 32 is fastened with the shaft rod 42. The stator 40 is fastened with the side of the impeller 32. The nozzle 50 is fastened with the outer end of the stator 40.

Figure 3:
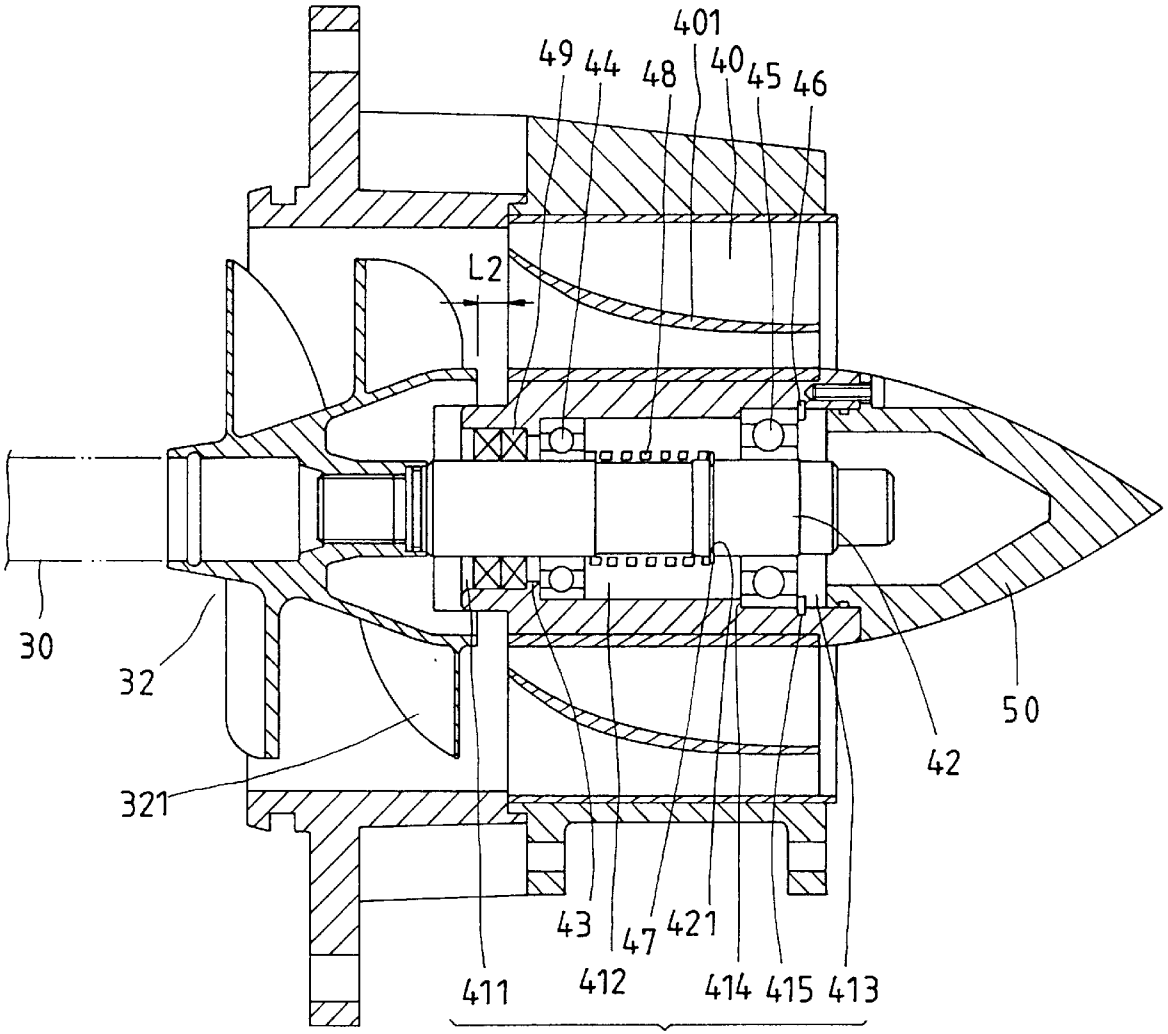
FIG. 3 shows a longitudinal sectional view of the propelling system of the present invention, with the gap between the impeller blades and the stator vanes being widened by the compressed spring.

When the water scooter is cruising at a high speed, the compressed water flow brought about by the blades 321 is greater relative to the composite thrust of the stator 40. The relative reaction force pushes in reverse the blades 321 to slide forward. The shaft rod 42 is thus actuated to slide forward simultaneously, thereby resulting in the compression of the spring 48. As a result, the gap L2 between the blades 321 of the impeller 32 and the stator vanes 401 of the stator 40 becomes greater, as shown in FIG. 3. The injection flow of the vanes has a better angle of attack $\alpha$ for improving the cruising efficiency of the water scooter.

When the water scooter is started to cruise or is cruising slowly, the water compression density of the propelling system or the amount of water is inadequate. As a result, the water bubbles are formed at the water discharge port of the water scooter. This is called the erosion phenomenon. In the meantime the shaft rod 42 is forced by the elastic force of the spring 48 to return to its original position, a shown in FIG. 2. The bearing 45 is once again pressed against by the retaining ring. As a result, the gap L1 between the blades 321 and the stator vanes 401 becomes smaller automatically, thereby resulting in the reduction in the erosion phenomenon.

What is claimed is:

1. A small boat propelling system mounted in a water channel of a hull of the small boat and composed of an engine, a transmission shaft driven by the engine, an impeller driven by the transmission shaft and provided with a plurality of blades, a stator mounted behind the impeller and provided with a plurality of stator vanes, and a nozzle located behind the stator; wherein the blades and the stator vanes are separated by a gap adjustable by a magnitude of jet flow of water.

2. The propelling system as defined in claim 1, wherein the stator has an axial hole various in diameter for fastening a shaft rod and the blades of the impeller, the axial hole provided in an inner edge of a front section thereof with an arresting protrusion such that the axial hole on both ends of the arresting protrusion forms a first round hole section and a second round hole section which is in turn provided in a rear end thereof with a third round hole section greater in diameter than the second round hole section so as to form a stepped portion between the third round hole section and the second round hole section, the third round hole section provided in a middle thereof with a retaining slot, a front bearing and a rear bearing being contiguous to the arresting protrusion and the stepped portion for keeping the shaft rod straight when in operation, and outer end of the rear bearing being pressed against by a retaining ring located in the retaining slot such that the rear bearing is located in the third round hole section, the shaft rod provided with a circular slot corresponding in location to an inner end of the rear bearing for engaging another retaining ring, an elastic element being fitted over the shaft rod such that both ends of the elastic element urge the front bearing and the retaining ring of the shaft rod, said first round hole section provided with at least one sealing member for preventing water from flowing into the axial hole of the stator.

3. The propelling system as defined in claim 2, wherein the elastic element is a spring.

4. The propelling system as defined in claim 2, wherein the sealing member is formed of two oil seals.

* * * * *